United States Patent [19]

Usami et al.

[11] Patent Number: 4,929,411

[45] **Date of Patent: * May 29, 1990**

[54] HEAT-SENSITIVE RECORDING MATERIAL

[75] Inventors: Toshimasa Usami; Akihiro Shimomura, both of Shizuoka, Japan

[73] Assignee: Fuji Photo Film Co., Ltd., Kanagawa, Japan

[ * ] Notice: The portion of the term of this patent subsequent to Apr. 11, 2006 has been disclaimed.

[21] Appl. No.: 278,320

[22] Filed: Dec. 1, 1988

[30] Foreign Application Priority Data

Dec. 1, 1987 [JP] Japan ..... 62-301561

[51] Int. Cl.[5] ..... B41M 5/18

[52] U.S. Cl. ..... 503/213; 427/150; 427/151; 503/214; 503/216; 503/217; 503/218; 503/221; 503/222

[58] Field of Search ..... 427/150–152; 503/214–218, 213, 221, 222

[56] References Cited

U.S. PATENT DOCUMENTS 4,820,682 4/1989 Shimomura et al. ..... 503/200

*Primary Examiner*—Bruce H. Hess

*Attorney, Agent, or Firm*—Sughrue, Mion, Zinn, Macpeak & Seas

[57] ABSTRACT

A heat-sensitive recording material obtained by coating on a support a composition comprising a microcapsulated colorless or light colored color-forming substance which can develop its color by reaction with an organic base, and an emulsified dispersion prepared by emulsifying an organic base dissolved in an organic solvent insoluble or slightly soluble in water, then drying the coat.

8 Claims, No Drawings

HEAT-SENSITIVE RECORDING MATERIAL

FIELD OF THE INVENTION

The present invention relates to a heat-sensitive recording material having one or more of a transparent heat-sensitive layer on a support and, more particularly, to a heat-sensitive recording material excellent in transparency and suitable for dichromatic recording.

BACKGROUND OF THE INVENTION

A heat-sensitive recording method has many advantages in that no particular developing step is required, (2) if paper is used as a support, the recording material can have a quality akin to that of plain paper, (3) handling of the recording material used is easy, (4) the images recorded have high color density, (5) this method can be effected using a simple and cheap apparatus and (6) no noise is caused during recording. Therefore, heat-sensitive recording materials have recently enjoyed a markedly increasing demand, particularly for use with a facsimile or printer, and have come to be used for many purpose.

From this situation, it has been desired to devise transparent heat-sensitive recording materials which enable direct recording with a thermal head in order to adapt them for multicolor development, or to make them usable for an overhead projector (hereafter abbreviated as OHP).

However, all heat-sensitive layers of known heat-sensitive recording materials to which the recording with a thermal head is applicable are opaque, and desired transparency cannot be realized even if a transparent support is employed as the support on which such heat-sensitive layers are to be provided.

On the other hand, conventional dichromatic recording methods which are applicable to heat-sensitive recording materials are classified into two types, a color-mixing type and a decolorizing type.

However, developed color image in the lower layer of the above-described decolorizing type dichromatic heat-sensitive recording material suffers from the defect that it has not only hue affected adversely by opacity of the upper heat-sensitive layer but also insufficient sharpness in itself.

As the result of our study on removal of the foregoing defect of conventional heat-sensitive materials, it has now been found that a heat-sensitive layer excellent in transparency can be obtained by selecting as a color former a combination of an organic base and a colorless or light colored color-forming substance capable of developing its color by reaction with said organic base, microcapsulating the latter and dispersing the former in the form of emulsion under a definite condition to prepare a coating composition, thus achieving the present invention.

SUMMARY OF THE INVENTION

Therefore, a first object of the present invention is to provide a heat-sensitive recording material excellent in transparency of the constituent heat-sensitive layer.

A second object of the present invention is to provide a decolorizing type dichromatic heat-sensitive material excellent in hue and image sharpness.

The above-described objects are attained with a heat-sensitive recording material obtained by coating on a support a composition comprising microcapsulated colorless or light colored color-forming substance which can develop its color by reaction with an organic base, and an emulsified dispersion prepared by emulsifying an organic base dissolved in an organic solvent insoluble or slightly soluble in water, then drying the coat.

When a transparent support is used in the heat-sensitive material of the present invention, and information is thermally recorded in the material, the resulting recording sheet can be applied to OHP as it is, because it has high transparency. Moreover, when the heat-sensitive material of the present invention is designed as a dichromatic recording material of conventional decolorizing type, improved hue and image sharpness can be achieved. Therefore, the present invention has a considerable significance.

DETAILED DESCRIPTION OF THE INVENTION

It is to be desired that the reaction of a colorless or light colored color-forming substance with an organic base which can be used in the present invention should be effected under heating. Color-forming substances preferred in the present invention are acidic leuco dyes of acylated lactone or sultone type, such as those represented by the following general formulae (I) to (V), especially those capable of developing deep colors under an alkaline condition, and that having slight solubility in water. Taking into account the practical usefulness, acidic leuco dyes of xanthene lactone type are of the greatest advantage in respects of the stability of the heat-sensitive coating composition, the stability of the heat-sensitive paper, the light resistance, the color-developing speed, the density of the developed color, and so on.

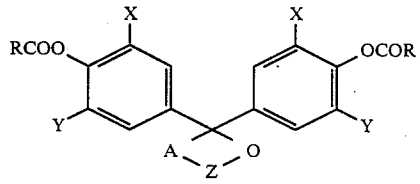

(I)

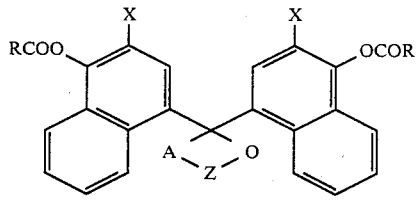

(II)

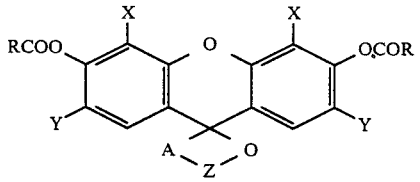

(III)

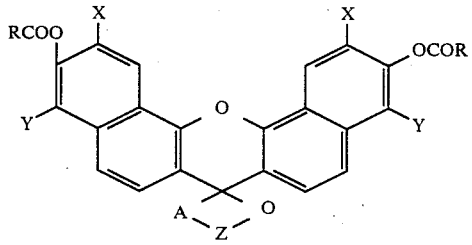

(IV)

-continued

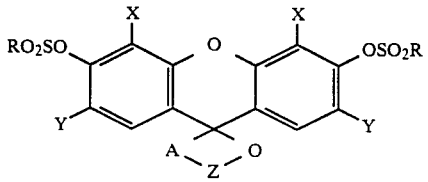

(V)

In the foregoing formulae, R represents phenyl group, a substituted phenyl group, a lower alkyl group, a lower alkoxy group, or a lower halogenated alkyl group; X and Y may be the same or different, and each represents a hydrogen atom, a halogen atom, a lower alkyl group, or nitro group; Z represents —CO— or —$SO_2$—; and A represents a saturated or unsaturated hydrocarbon group necessary to form a 5- or 6- membered ring together with Z, O and the carbon atom which is a constituent atom of the xanthene ring and attached to O, said group including those fused together with a benzene ring, a halogen-substituted benzene ring, a naphthalene ring, a cyclohexane ring, or so on.

Specific examples of acidic leuco dyes of the foregoing type are illustrated below.

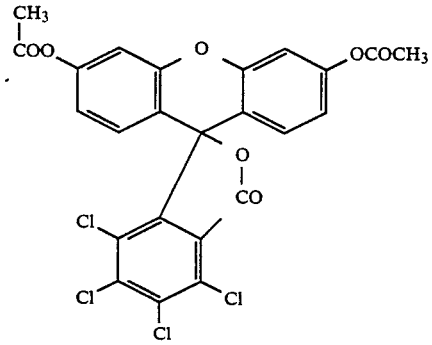

(1)

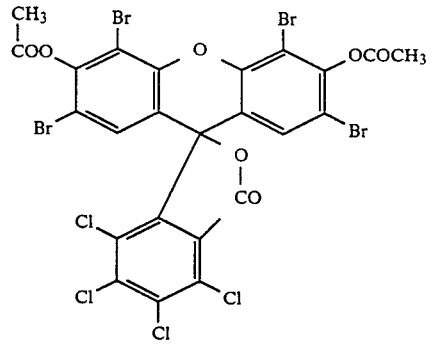

(2)

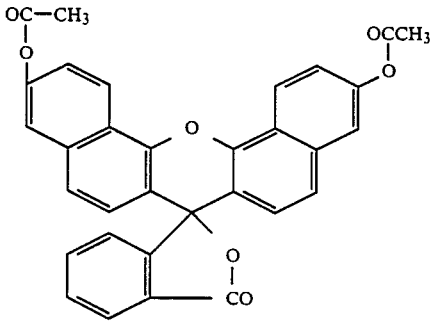

(3)

-continued

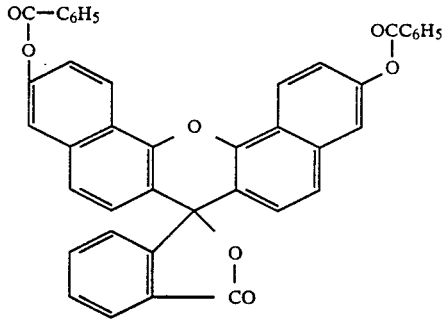

(4)

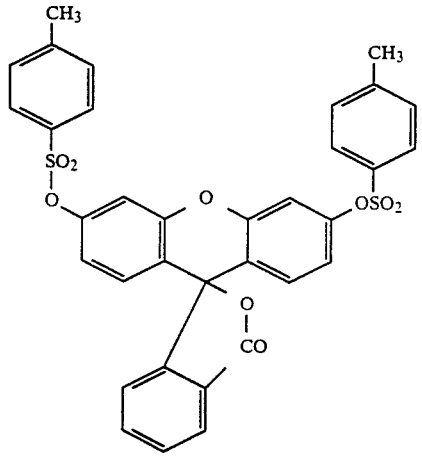

(5)

In addition to these color-forming substances, compounds of the kind which undergo coloration or color change under an alkaline condition, such as pH indicators, fluorescein derivatives, phenolphthalein derivatives, sulfophthalein derivatives, etc., and compounds of the kind which cause a color change phenomenon through oxidation or reduction in a broad sense which takes place as the result of a pH shift towards the alkaline side, such as ninhydrin derivatives, etc., can be used. Specific examples of compounds of the above-described kinds are illustrated below.

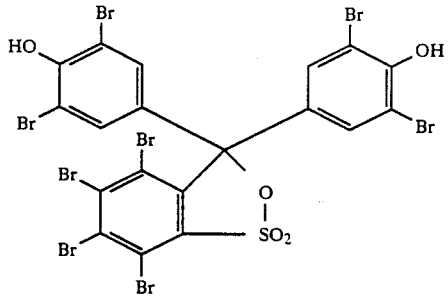

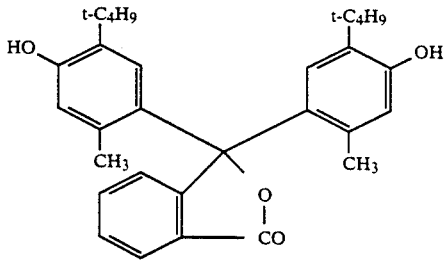

-continued

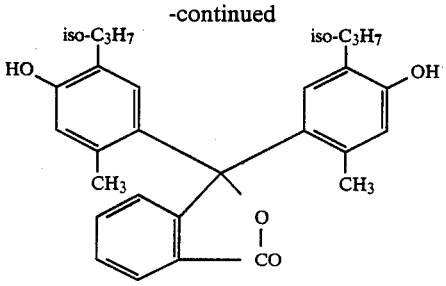

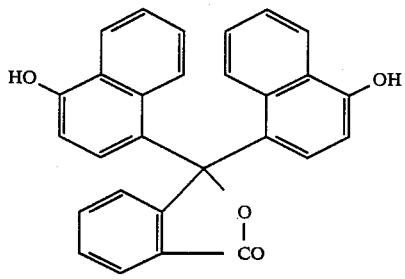

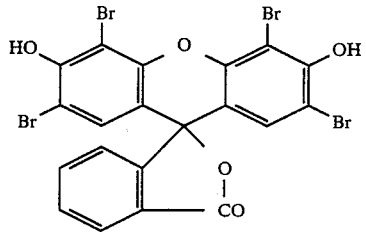

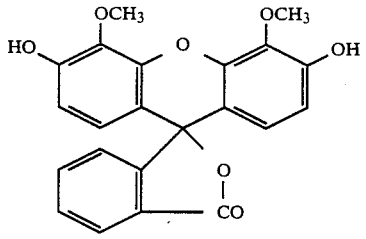

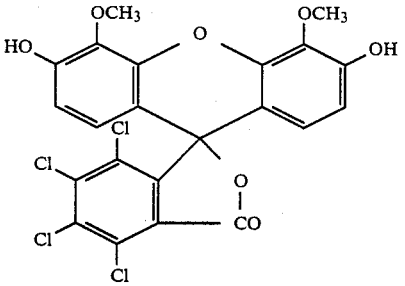

Microencapsulation of the above-described color former in the present invention can prevent generation of fog during production of a heat-sensitive material and, at the same time, can improve a freshness keeping quality of a heat-sensitive material and a keeping quality of the record formed. Therein, the image density at the time of recording can be heightened by properly selecting a material and a method for forming a microcapsule wall.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pyrrolidone, polyvinyl alcohol, and so on. These macromolecular substances can be used in combination of two or more thereof in the present invention.

Of the above-cited macromolecular substances, polyurethane, polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 242094/84 (the term "OPI" as used herein means an "unexamined published application"), and so on can be referred to.

An organic solvent to constitute the above-described oil droplets can be properly selected from those used generally for pressure sensitive material.

Some of desirable oils are compounds represented by the following general formulae (VI) to (VIII), triarylmethanes (such as tritoluylmethane, toluyldiphenylmethane), terphenyl compounds (such as terphenyl), alkylated diphenyl ethers (such as propyldiphenyl ether), hydrogenated terphenyl compounds (such as hexahydroterphenyl), diphenyl ethers, chlorinated paraffins and so on.

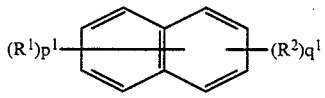

(VI)

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less.

Preferred alkyl groups represented by $R^1$ and $R^2$ are those containing 1 to 8 carbon atoms.

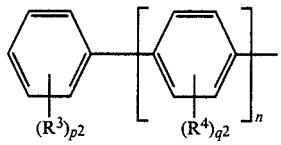

(VII)

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of $n=1$, while it is 6 or less in case of $n=2$.

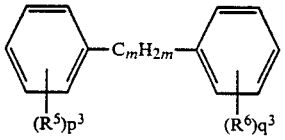

(VIII)

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (VI) include dimethylnaphthalene, diethylnaphthalene, diisopropylnaphthalene, and the like.

Specific examples of the compounds represented by the formula (VII) include dimethylbiphenyl, diethylbiphenyl, diisopropylbiphenyl, diisobutylbiphenyl, and the like.

Specific examples of the compounds represented by the formula (VIII) include 1-methyl-1-dimethylphenyl-1-phenylmethane, 1-ethyl-1-dimethylphenyl-1-phenylmethane, 1-propyl-1-dimethylphenyl-1-phenylmethane, and the like.

The above-cited oils can be used as a mixture of two or more thereof, or in combination with other oils.

Desirable microcapsules which are produced in the above-described manner are not those of the kind which are disrupted by heat or pressure, but those of the kind which have a microcapsule wall through which reactive substances present inside and outside the individual microcapsules respectively can permeate at high temperature to react with each other.

Multicolored neutral tints can be effected by preparing some kinds of microcapsules having walls differing in glass transition point through proper selection of wall materials, and optional addition of glass transition point controlling agents (e.g., plasticizers described in Japanese Patent Application (OPI)No. 277490/85) to the wall materials, respectively, and further by combining selectively colorless electron donating dye precursors differing in hue with their respective color developers. Therefore, the present invention is not limited to a monochromatic heat sensitive recording material but can be applied to a two-color or multicolor heat-sensitive recording material and a heat-sensitive recording material suitable for recording of graded image.

In addition, a photodiscoloration inhibitor as described, e.g., in Japanese Patent Application (OPI) Nos. 283589/85, 283590/85 and 283591/85 can be added, if desired.

Organic bases which can cause color development by reacting with color-forming substances usable in the present invention under applied heat can be property selected from known ones. In particular, guanidine derivatives represented by the following general formulae are preferred over others in practical point of view:

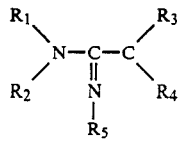

or

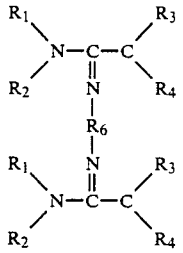

(wherein $R_1$, $R_2$, $R_3$, $R_4$ and $R_5$ each represents a hydrogen atom, an alkyl group containing not more than 18 carbon atoms, a cycloalkyl group, an aryl group, an aralkyl group, an amino group, an alkylamino group, an acylamino group, a carbamoyl amino group, an amidino group, a cyano group, or a heterocyclyl group; $R_6$ represents a lower alkylene group, a phenylene group, a naphthylene group, or

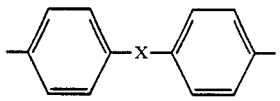

(wherein X represents a lower alkylene group, $—SO_2—$, —S—S—, —S—, —O—, —NH—, or a single bond); and the aryl group(s), if contained, may be substituted by one or more of a group selected from among lower alkyl groups, alkoxy groups, nitro group, acylamino groups, alkylamino groups and halogen atoms). Specific examples of guanidine derivatives are illustrated below. However, the invention should not be construed as being limited to these examples.

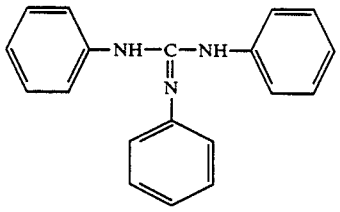

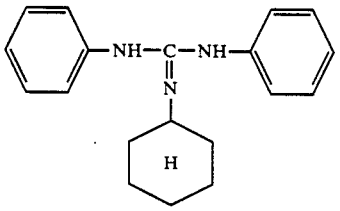

-continued

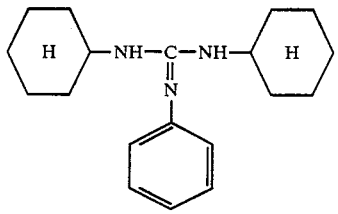

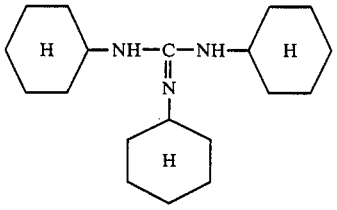

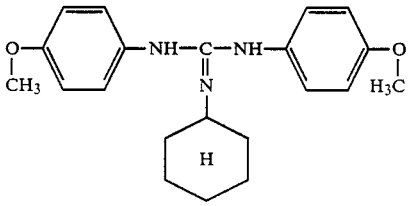

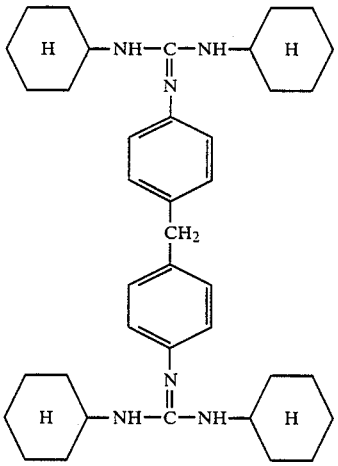

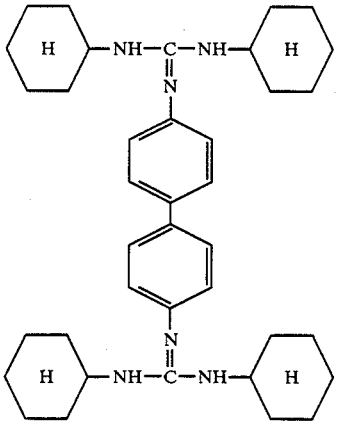

In addition to the foregoing guanidine derivatives, compounds represented by the following general formula can be employed as the organic base of the present invention:

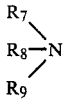

(wherein $R_7$,$R_8$ and $R_9$ each represent a hydrogen atom, an alkyl group containing not more than 18 carbon atoms, an amino-substituted alkyl group, a cycloalkyl group, an aralkyl group or a heterocyclyl group, or at least any two of them may combine with each other at the sites other than those attached to N to form a ring together with N). Specific examples of these compounds include N,N,N',N'-tetrabenzyl-hexamethylenediamine,decamethylenediamine, 2-aminobenzoxazole, 2-aminobenzothiazole and 2-aminobenzimidazole.

These organic bases can be easily synthesized according to known methods or analogous methods thereto.

In the present invention, such organic bases are used in a form of emulsified dispersion. The dispersion can be prepared by dissolving organic bases in an organic solvent slightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the organic bases can be properly selected from known organic solvents slightly soluble or insoluble in water. However, organic solvents having boiling point lower than 150° C. are desirable to improve heat sensitivity. Some of these organic solvents are ethylacetate, isopropyl acetate, butyl acetate, methylene chloride, and the like.

In the present invention, esters having high boiling point or before mentioned oils used for pressure sensitive materials can be added to the above organic solvents if needed. In particular, the addition of esters is desired from a view point of a stability of the organic base dispersed emulsion.

Specific example of esters having a high boiling point include phosphates (e.g., triphenyl phosphate, tricresyl phosphate, butyl phosphate, octyl phosphate, cresyl-biphenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates(e.g., ethyl abietate, benzyl abietate), dioctyl adipate, diethyl succinate, isodecyl succinate, dioctyl azelate, oxalates (e.g., dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the organic bases.

Water soluble high polymers to be contained as a protective colloid in an aqueous phase, which is to be mixed with an oily phase wherein organic bases are dissolved, can be selected properly from known anionic, nonionic or amphoteric high polymers. Of these high polymers, polyvinylalcohol, gelatin, cellulose derivatives and the like are preferred. A partially saponified polyvinyl alcohol, especially one having saponification value of 75–90% is the most desirable.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium dodecylbenzenesulfonate), sodium alkylsulfate, sodium dioctylsulfosuccinates, polyalkylene glycols (such as polyoxyethylene nonylphenyl ether) and so on.

To the emulsified dispersion thus obtained, melting point depressants for the organic bases can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japanese Patent Application No. 244190/84.

These melting point depressants can be used in an amount of 0.1 to 2 parts by weight, preferably 0.5 to 1 part by weight, per 1 part by weight of organic bases whose melting point is to be depressed. It is to be desired that the melting point depressant and the organic bases whose melting point can be depressed thereby, should be used in the same place. When they are added to separate places, a preferred addition amount of the melting point depressant is 1 to 3 times of that of the above-described one.

The heat sensitive recording material can be formed using a coating technique with the aid of an appropriate binder.

As for the binder such as a polyvinyl alcohol, a methyl cellulose, a carboxymethyl cellulose, a hydroxypropyl cellulose, a gum arabic, a gelatin, a polyvinyl pyrrolidone, a casein, a styrene-butadiene latex, an acrylonitrile-butadiene latex, a polyvinyl acetate, a polyacrylate, various kind of emulsions such as an ethylene-vinyl acetate copolymer emulsion, and so on, can be employed. An amount of the binder used is 0.5 to 5 g per square meter on a solids basis.

The heat-sensitive recording material is produced by providing a heat-sensitive layer on a support, such as paper, a synthetic resin film, etc., coating and drying a coating composition, in which microcapsules enclosing a color former therein and a dispersion containing at least an organic bases in an emulsified condition are contained as main components, and further a binder and other additives are incorporated. A coverage of the heat-sensitive layer is controlled to 2.5 to 25 g/m$^2$ on a solids basis. It is a surprise to find that thus prepared heat-sensitive layer has quite excellent transparency, though the reason for its transparency is not elucidated.

The transparency can be estimated by measuring Haze (%) using HTR meter (integrating-sphere photometer) manufactured by Nippon Seimitus Kogyo K.K. However, for the transparency of a heat-sensitive layer of a test sample is remarkably affected by light-scattering caused by minute roughness of a surface of the heat sensitive layer. Therefore, a transparent adhesive tape is stuck on the surface of the heat-sensitive layer to prevent the light scattering then measurement is carried out to estimate an intrinsic transparency of the heat-sensitive layer.

For the purpose of prevention of sticking to a thermal head, and improvement on writing quality, pigments such as silica, barium sulfate, titanium oxide, aluminium hydroxide, zinc oxide, calcium carbonate, etc., styrene beads, or fine particles of urea/melamine resin and so on can be added to the heat-sensitive recording material of the present invention. In order to keep the transparency of the heat-sensitive layer, it is to be desired that the above-described pigments and so on should be added to a protective layer which is provided on the heat sensitive layer in a conventional manner for the purpose of acquisition of keeping quality and stability. Details of the protective layer are described in "Kami Pulp Gijutsu Times", pp. 2 to 4 (Sept. 1985).

Also, metal soap can be added for the purpose of prevention of the sticking phenomenon. They are used at a coverage of 0.2 to 7 g/m$^2$.

As for the paper to be used as a support, neutralized paper which is sized with a neutral sizing agent like an alkylketene dimer and shows pH 6–9 upon hot extraction is employed to advantage in the respect of long-range shelf life.

In order to prevent the penetration of a coating composition into paper, and in order to effect a close contact between a heat recording head and a heat-sensitive recording layer, paper described in Japanese Patent Application (OPI) No. 116687/82, which is characterized by Stokigt sizing degree/(meter basis weight)$^2 \geqq 3 \times 10^{-3}$ and Bekk smoothness of 90 seconds or more, is used to advantage.

In addition, paper having optical surface roughness of 8 microns or less and a thickness of 40 to 75 microns, as described in Japanese Patent Application (OPI) No. 136492/83; paper having a density of 0.9 g/cm$^3$ or less and optical contact rate of 15% or more, as described in Japanese Patent Application (OPI) No. 69097/83; paper which is prepared from pulp having received a beating treatment till its freeness has come to 400 cc or more on a basis of Canadian Standard Freeness (JIS P8121) to prevent permeation of a coating composition thereinto, as described in Japanese Patent Application (OPI) No. 69097/83; raw paper made with a Yankee paper machine, which is to be coated with a coating composition on the glossy side (and thereby improvements on developed color density and resolution are obtained) as described in Japanese Patent Application (OPI) No. 65695/83; and raw paper which has received a corona discharge processing (and thereby its coating aptitude has been enhanced) as described in Japanese Patent Application (OPI) No. 35985/84 and so on can be employed in the present invention, and can bring about good results. In addition to the above-described papers, all supports which have so far been used for general heat-sensitive recording papers can be employed as the support of the present invention.

The term transparent support as used herein is intended to include film of polyesters such as polyethylene terephthalate, polybutylene terephthalate and the like, cellulose derivative films like a cellulose triacetate film polyolefin films such as a polystyrene film, a polypropylene film, a polyethylene film and the like and so on. These films may be used, independently or in a laminated form.

A preferred thickness of such a transparent support is within the range of 20 to 200 microns, particularly 50 to 100 microns.

A subbing layer may be employed in the present invention to increase the adhesiveness between the transparent support and the heat-sensitive layer. A subbing layer may be made of gelatin, synthetic high polymer latexes, nitrocellulose, and so on. A preferred coverage of the subbing layer is from 0.1 to 2.0 g/m$^2$, particularly 0.2 to 1.0 g/m$^2$. When the coverage is below 0.1 g/m$^2$, adhesion of the heat-sensitive layer to the support is insufficient, whereas even when it is increased beyond 2.0 g/m$^2$, there is no increase in adhesion power.

It is desired that the subbing layer should be hardened with a hardener because it sometimes swells upon contact with water contained in the heat-sensitive layer coated thereon to cause deterioration of image formed in the heat-sensitive layer.

Examples of hardeners which can be used in the subbing layer are:

(1) active vinyl-containing compounds, such as divinylsulfone, N,N'-ethylenebis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine, and the like, (2) active halogen-containing compounds, such as sodium salt of 2,4-dichloro-6-hydroxy-s-triazine, 2,4-dichloro-6-methoxy-s-triazine, sodium salt of 2,4-dichloro-6-(4-sulfoanilino)-s-triazine, 2,4-dichloro-6-(2-sulfoethylamino)-s-triazine, N,N'-bis(2-chloroethylcarbamyl)piperazine, and the like, (3) epoxy compounds, such as bis(2,3epoxypropyl)-methylpropylammonium-p-toluenesulfonate, 1,4-bis(2',3'-epoxypropyloxy)-butane, 1,3,5-triglycidylisocyanurate, 1,3-diglycidyl-5-(γ-acetoxy-β-oxypropyl)isocyanurate, and the like.

(4) ethyleneimino compounds, such as 2,4,6-triethylene-s-triazine, 1,6,-hexamethylene-N,N'-bisethyleneurea, bis-β-ethyleneiminoethylthioether, and the like, (5) methanesulfonate compounds, such as 1,2-di(methanesulfonoxy)ethane, 1,4-di(methanesulfonoxy)butane, 1,5-di(methanesulfonoxy)pentane, and the like, (6) carbodiimide compounds, such as dicyclohexylcarbodimide, 1-cyclohexyl-3-(3-trimethylaminopropyl)-carbodiimido-p-triethanesulfonate, 1-ethyl-3-(3-dimethylaminopropyl)carbodiimide hydrochloride, and the like, (7) isooxazole compounds, such as 2,5-dimethylisooxazole perchlorate, 2-ethyl-5-phenylisooxazole-3-sulfonate, 5,5'-(p-phenylene)bisisooxazole, and the like, (8) inorganic compounds, such as chrome alum, boric acid, zirconium salt, chromium acetate, and the like, (9) dehydrating condensation type peptide reagents such as N-carboethoxy-2-isopropoxy-1,2-dihydroquinoline, N-(1-morpholinocarboxy)-4-methylpyridinium chloride and the like, and active ester compounds such as N,N'-adipolyldioxydisuccinimide, N,N'-terephthaloyl-dioxy-disuccinimide and the like, and

(10) isocyanates, such as toluene-2,4-diisocyanate, 1,6-hexamethylenediisocyanate and the like.

(11) aldehydes such as glutaric aldehyde, glyoxal, dimethoxy urea, 2,3-dihydroxy-1,4-dioxane and the like.

Among these hardeners, especially aldehydes such as the glutaric aldehyde, the 2,3-dihydroxy-1,4-dioxane etc. and the boric acid are preferable.

Such a hardener is added in a proportion ranging from 0.20 to 3.0 wt % to the weight of the materials to constitute the subbing layer. A suitable amount to be added can be selected depending on the coating method and the intended degree of hardening.

When the addition amount of a hardener is below 0.20 wt %, sufficient hardening can not be achieved however long is the time elapsed, and therefore the subbing layer swells upon coating of the heat-sensitive layer, whereas when the hardener is added in a concentration higher than 3.0 wt % the hardening proceeds too fast, and therefore the adhesiveness between the subbing layer and the support is lowered to result in peeling off the subbing layer from the support.

According to the hardener used, the pH of a coating solution for the subbing layer can be rendered alkaline by the addition of sodium hydroxide or the like, or acidic by the addition of citric acid or the like, if needed.

Further, a defoaming agent can be added in order to eliminate foam generated upon coating, and a surface active agent can also be added in order to level the surface of the coating solution to a good condition to result in prevention of coating streaks.

Furthermore, an antistatic agent can be added, if needed.

Before coating of the subbing layer, the surface of a support is preferably subjected to an activation processing according to known methods. As a method for the activation processing, mention may be made of an etching processing with an acid, a flame processing with a gas burner, a corona discharge processing or glow discharge processing. From the viewpoint of cost or simplicity, corona discharge processing described in U.S. Pat. Nos. 2,715,075, 2,846,727, 3,549,406 and 3,590,107, and so on are employed to the greatest advantage.

Coating compositions prepared in accordance with the present invention are coated by well known processes such as a dip coating process, an air knife coating process, a curtain coating process, a roller coating process, a doctor coating process, a wire bar coating process, a slide coating process, a gravure coating process or an extrusion coating process, using a hopper described in U.S. Pat. No. 2,681,294, or so on. Two or more of different coating composition can be coated simultaneously, if desired, using methods described in U.S. Pat. Nos. 2,761,791, 3,508,947, 2,941,898, and 3,526,528 or Yuji Harasaki, Coating Kogaku (which means "Coating Engineering"), p.253, Asakura Shoten (1973), and so on. An appropriate method can be chosen from the above-cited ones depending on intended coverage coating speed, and so on.

The coating compositions used in making the material may include additives such as a pigment dispersing agents, a viscosity increasing agent, a fluidity modifying agent, a defoaming agent, a foam inhibitor, a mold lubricant, a coloring agent and so on so far as they have no adverse influences upon characteristics of the material.

An image recorded in a heat-sensitive material of the present invention can be observed from one side as transmitted image or reflected image. In the latter case, the image is not clear since the back side is seen through the background area. Therefore, a white pigment may be added to a heat sensitive layer, or a layer containing a white pigment may be additionally provided. In both cases, it is effective to add a white pigment to the outermost layer located on an opposite side of the recorded-image observation. Suitable example of white pigments include talc, calcium carbonate, calcium sulfate, magnesium carbonate, magnesium hydroxide, alumina, synthetic silica, titanium oxide, barium sulfate, kaolin, calcium silicate, urea resin, and so on.

A preferred size of particles dispersed is 10 microns or less.

The heat-sensitive recording material of the present invention can be designed so as to not only fit OHP use but also accord with various embodiments depending on enduse purposes. In one embodiment, for instance, the material of the present invention can have on a support two or more of the heat-sensitive layers of the invention, which differ in color to be developed, via a protective layer or a subbing layer. In another embodiment, one layer selected from among conventional light-sensitive, heat-sensitive and light- and heat-sensitive materials can be provided on a support, and thereon can be provided the substantially transparent heat-sensitive layer of the present invention.

EXAMPLES

The present invention is illustrated in greater detail by reference to the following examples. However, the invention should not be construed as being limited to these examples.

EXAMPLE 1

Preparation of Capsule Solution

| | |
|---|---|
| The following coloring compound | 14 g |

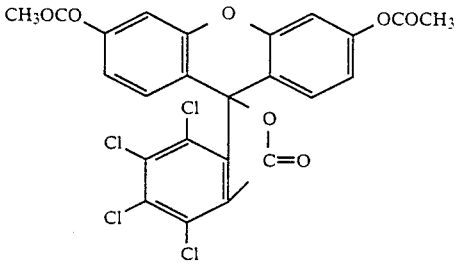

| | |
|---|---|
| Takenate D 110N (Trade name of capsule wall material, produced by Takeda Yakuhin K.K.) | 60 g |
| Sumisoap 200 (Trade name of ultraviolet absorbent, produced by Sumitomo Kagaku K.K.) | 2 g |
| 1-phenyl-1-xylylethane | 55 g |
| methylene chloride | 30 g |
| ethyl acetate | 30 g |

The solution consisting of the above-described materials was mixed with an aqueous solution constituted with 100 g of a 8% water solution of polyvinyl alcohol (PVA 217E: manufactured by Kurare K.K.), 40 g of water and emulsified with stirring at 10,000 r.p.m. for 5 minutes using Ace Homogenizer made by Nippon Seiki K.K.. Then, the resulting emulsion was diluted with 150 g of water, and allowed to stand at 40° C. for 3 hours to conduct the microencapsulation reaction therein. Thus, a solution containing microcapsules having a size of 1.1 micron was obtained.

Preparation of Organic Base Emulsified Dispersion

The organic bases (a)20 g, (b)15 g and (c)5 g, illustrated below, were dissolved in 8 g of tricresyl phosphate and 30 g of ethyl acetate. The obtained solution above-described was mixed with 100 g of a 8% water solution of polyvinyl alcohol, 150 g of water and 0.5 g of sodium dodecylbenzen sulfonate, and emulsified with stirring at 10,000 r.p.m. for 5 minutes using Ace Homogenizer made by Nippon Seiki K.K. to prepare on emulsified dispersion having particle size of 0.7 micron.

Organic base (a)

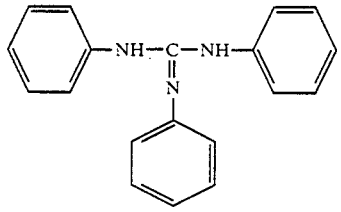

Organic base (b)

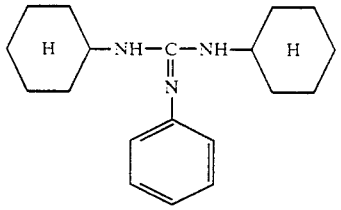

Organic base (c)

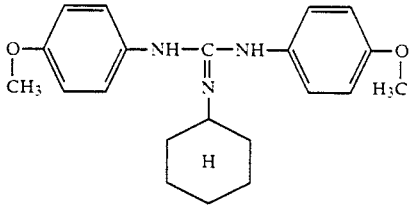

Production of a Heat-Sensitive Recording Material

A 5.0 g of the above-described capsule solution, a 10.0 g of the organic base-emulsified dispersion and 5.0 g of water were mixed with stirring, coated on a 70 microns transparent polyethylene terephthalate (PET) film support at a coverage of 15 g/m$^2$ on a solids basis, and dried. Thereon, 2 micron protective layer of the following composition was further provided to produce a transparent heat-sensitive film.

Composition of Protective Layer

| | |
|---|---|
| 10% Polyvinyl Alcohol | 20 g |
| Water | 30 g |
| 2% Sodium Dioctylsulfosuccinate | 0.3 g |
| Kaolin Dispersion (prepared by dispersing 3 g of polyvinylalcohol, 100 g of water and 35 g of Kaolin with a ball mill) | 3 g |
| Hidolin Z-7 (Trade name of product of Chukyo Yushi K.K.) | 0.5 g |

Printing was carried out on the thus obtained heat-sensitive material using High Fax 4300(GIII mode, manufactured by Hitachi K.K.) to coloring a magenta image. The density of the coloring image measured by a MacBeth transmission densitometer was 0.7. The obtained image was able to submitt to projection with an overhead projector as it was.

EXAMPLE 2

A magenta image having a coloring density of 0.6 was obtained in a same manner as in Example 1 except the following coloring compound was used instead of one used in Example 1.

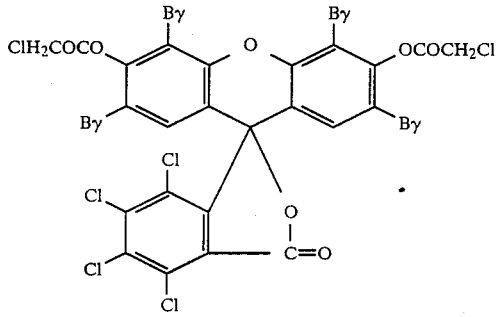

EXAMPLE 3

A green image having a coloring density of 0.7 was obtained in a same manner as in Example 1 except the following coloring compound was used instead of one used in Example 1.

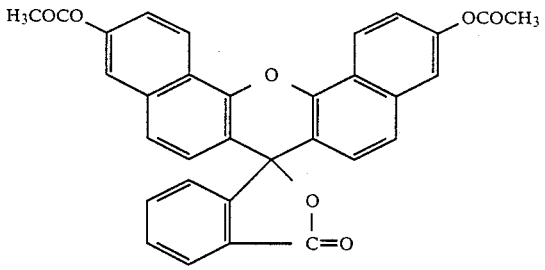

EXAMPLE 4

An Orange image having a coloring density of 0.7 was obtained in a same manner as in Example 1 except the following coloring compound was used instead of one used in Example 1.

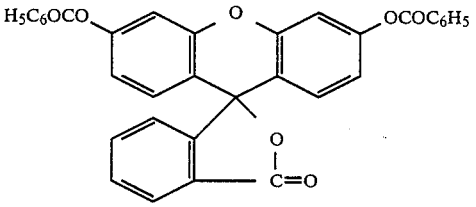

EXAMPLE 5

A magenta image having a coloring density of 0.5 was obtained in a same manner as in Example 1 except the following coloring compound was used instead of one used in Example 1.

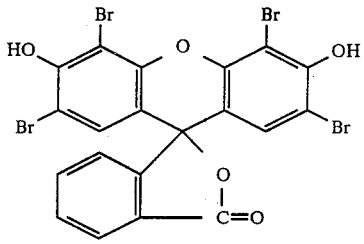

EXAMPLE 6

A blue image having a coloring density of 0.5 was obtained in a same manner as in Example 1 except the following coloring compound was used instead of one used in Example 1.

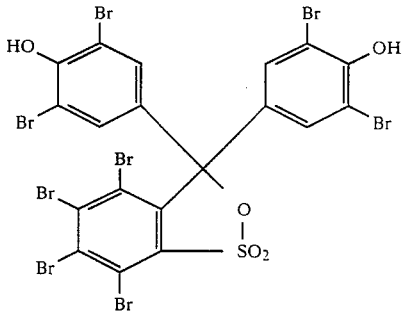

EXAMPLE 7

A blue image having a coloring density of 0.4 was obtained in a same manner as in Example 1 except the following coloring compound was used instead of one used in Example 1.

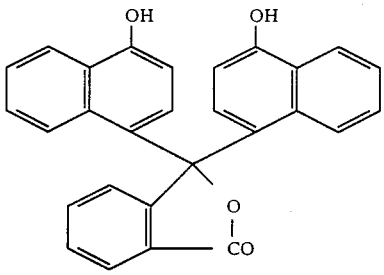

EXAMPLE 8

A dichromatic recroding material was prepared by providing the following cyan coloring unit (heat-sensitive layer and protective layer) on the transparent magenta heat-sensitive layer of Example 1.

Preparation of a Capsule Solution for Cyan Coloring Heat-Sensitive Layer 14 g of Crystal Violet lactone (leuco dye), 60 g of Takenate D 110N (Trade name of capsule wall material, produced by Takeda Yakuhine K.K.) and 2 g of Sumisoap 200 (Trade name of ultraviolet absorbent, produced by Sumitomo Kagaku K.K.) were added to a mixed solvent consisting of 55 g of 1-phenyl-1-xylylethane and 55 g of methylene chloride, and dissolved therein. The solution of the above-described leuco dye was mixed with an aqueous solution constituted with 100 g of a 8% water solution of polyvinyl alcohol, 40 g of water and 1.4 g of a 2% water solution of sodium dioctylsulfosuccinate (dispersant) and emulsified with stirring at 10,000 r.p.m. for 5 minutes using Ace Homogenizer made by Nippon Seiki K.K.. Then, the resulting emulsion was diluted with 150 g of water, and allowed to stand at 40° C. for 3 hours to conduct the microcapsulation reaction having a size of 0.7 micron was obtained.

Preparation of Color Developer-emulsified Dispersion

The color developers (a)8 g, (b)4 g and (c)30 g, illustrated below, were dissolved in 8.0 g of 1-phenyl-1-xylylethane and 30 g of ethyl acetate. The obtained solution of the color developers was mixed with 100 g of a 8% water solution of polyvinyl alcohol, 150 g of water and 0.5 g of sodium dodecylbenzensulfonate, and emulsified with stirring at 10,000 r.p.m. for 5 minutes at ordinary temperature using Ace Homogenizer made by Nippon Seiki K.K. to prepare an emulsified dispersion having a mean particle size of 0.5 micron.

Color Developer (a)

Zinc salt of

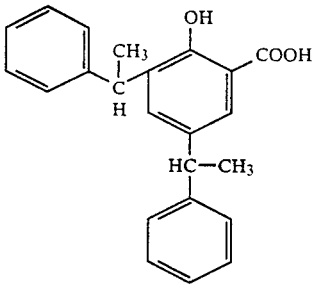

Color Developer (b)

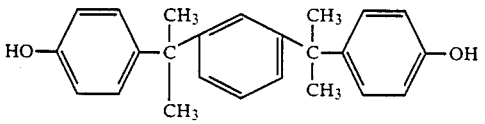

Color Developer (c)

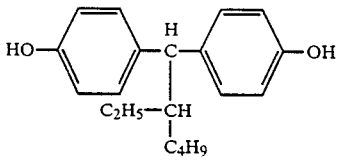

Coating of Cyan Coloring Heat-Sensitive Layer

A 5.0 g of the above-described capsule solution, a 10.0 g of the color developer-emulsified dispersion and 5.0 g of water were mixed with stirring, then the obtained solution was coated on a magenta heat-sensitive layer of example 1 at a coverage of 16 g/m$^2$ on a solids basis, and dried. Thereon, a 2 micron protective layer having the following composition was further provided to produce a transparent heat-sensitive film.

Composition of Protective Layer

| | |
|---|---|
| 10% Polyvinyl Alcohol | 20 g |
| Water | 30 g |
| 2% Sodium Dioctylsulfosuccinate | 0.3 g |
| Kaolin Dispersion (prepared by dispersing 3 g of polyvinylalcohol, 100 g of water and 35 g of Kaolin with a ball mill) | 3 g |
| Hidolin Z-7 (Trade name of product of Chukyo Yushi K.K.) | 0.5 g |

Printing was carried out by a condition of 15 m sec of pulse frequency and 0.46 W/dot on the thus obtained heat-sensitive material using a thermal printing test machine made by Matsushita Electric Parts K.K. A cyan image (D=0.45) was obtained by 0.5m sec thermal printing and a magenta image (D=0.8) was obtained by 5m sec thermal printing. A dichromatic transparent image was obtained using an over head projector. By this example, it is clear that a discoloring type dichromatic recording material which had been obtained as nontransparent material was successfully changed into transparent recording material.

What is claimed is:

1. A heat-sensitive recording material which is comprised of a support having thereon at least one transparent heat-sensitive layer containing an organic base and microcapsules enclosing at least one colorless or light colored coloring material which can color by reaction with the organic base, wherein the transparent heat-sensitive layer is provided by coating a solution prepared by mixing the microcapsules with an emulsified dispersion obtained by mixing and emulsifying the organic base dissolved in an organic solvent which is slightly soluble or insoluble in water with aqueous solution, then drying the coat.

2. The heat-sensitive recording material as claimed in claim 1, wherein said colorless or light colored coloring material is a leuco dye of a xanthene lactone type expressed by the following general formula:

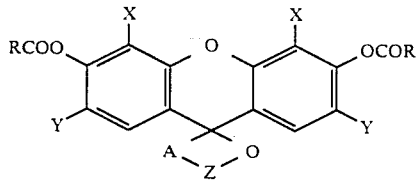

(III)

wherein R represents phenyl group, a substituted phenyl group, a lower alkyl group, a lower alkoxy group, or a lower halogenated alkyl group; X and Y may be the same or different, and each represents a hydrogen atom, a halogen atom, a lower alkyl group, or nitro group; Z represents —CO— or —$SO_2$—; and A represents a saturated or unsaturated hydrocarbon group necessary to form a 5- or 6-membered ring together with Z, O and the carbon atom which is a constituent atom of the xanthene ring and attached to O, said group including those fused together with a benzene ring, a halogen-substituted benzene ring, a naphthalene ring, a cyclohexane ring.

3. The heat-sensitive recording material as claimed in claim 1, wherein said colorless or light colored coloring material is at least one leuco dye of xanthene lactone type expressed by the following general formula:

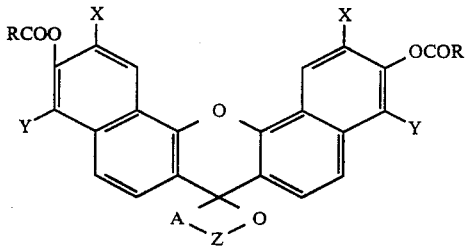

(IV)

wherein R represents phenyl group, a substituted phenyl group, a lower alkyl group, a lower alkoxy group, or a lower halogenated alkyl group; X and Y may be the same or different, and each represents a hydrogen atom, a halogen atom, a lower alkyl group, or nitro group; Z represents —CO— or —$SO_2$—; and A represents a saturated or unsaturated hydrocarbon group necessary to form a 5456 ring together with Z, O and the carbon atom which is a constituent atom of the xanthene ring and attached to O, said group including those fused together with a benzene ring, a halogen-substituted benzene ring, a naphthalene ring, a cyclohexane ring.

4. The heat-sensitive recording material as claimed in claim 1, wherein said colorless or light colored coloring material is at least one leuco dye of xanthene lactone type expressed by the following general formula:

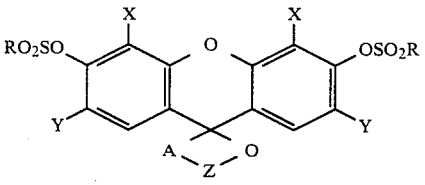

(V)

wherein R represents phenyl group, a substituted phenyl group, a lower alkyl group, a lower alkoxy group, or a lower halogenated alkyl group; X and Y may be the same or different, and each represents a hydrogen atom, a halogen atom, a lower alkyl group, or nitro group; Z represents —CO— or —$SO_2$—; and A represents a saturated or unsaturated hydrocarbon group necessary to form a 5- or 6-membered ring together with Z, O and the carbon atom which is a constituent atom of the xanthene ring and attached to O, said group including those fused together with a benzene ring, a halogen-substituted benzene ring, a naphthalene ring, a cyclohexane ring.

5. The heat-sensitive recording material as claimed in claim 1, wherein said organic base is at least one guanidine derivatives expressed by the following general formula:

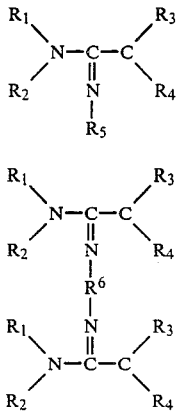

wherein $R_1$, $R_2$, $R_3$, $R_4$ and $R_5$ each represents a hydrogen atom, an alkyl group containing not more than 18 carbon atoms, a cycloalkyl group, an aryl group, an aralkyl group, an amino group, an alkylamino group, an acylamino group, a carbamoyl amino group, an amidino group, a cyano group, or a heterocyclyl group; $R_6$ represents a lower alkylene group, a phenylene group, a naphthylene group, or

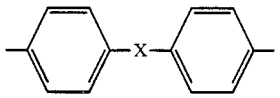

wherein X represents a lower alkylene group, —$SO_2$—, —S—S—, —S—, —O—, —NH—, or a single bond); and the aryl group(s), if contained, may be substituted by one or more of a group selected from among lower alkyl groups, alkoxy groups, nitro group, acylamino groups, alkylamino groups and halogen atoms.

6. A process for producing a heat-sensitive recording material which is comprised of a support having thereon at least one transparent heat-sensitive layer containing an organic base and microcapsules enclosing at least one colorless or light colored coloring material which can color by reaction with the organic base, wherein the transparent heat-sensitive layer is provided by coating a solution prepared by mixing the microcapsules with an emulsified dispersion obtained by mixing and emulsifying the organic base dissolved in an organic solvent which is slightly soluble or insoluble in water with aqueous solution, then drying the coat.

7. A process for producing a heat-sensitive recording material as claimed in claim 6, wherein said organic solvent contains at least one ester.

8. A process for producing a heat-sensitive recording material as claimed in claim 7, wherein said organic solvent is an ester or a mixture of esters.

* * * * *